US005107904A

United States Patent [19]

Van Mullekom

[11] Patent Number: 5,107,904

[45] Date of Patent: Apr. 28, 1992

[54] LOOM HAVING A COMPACT BOBBIN HOLDER

[75] Inventor: Hubert P. Van Mullekom, Deurne, Netherlands

[73] Assignee: Sulzer Brothers Limited, Winterthur, Switzerland

[21] Appl. No.: 582,963

[22] PCT Filed: Mar. 1, 1990

[86] PCT No.: PCT/CH90/00049

§ 371 Date: Sep. 12, 1990

§ 102(e) Date: Sep. 12, 1990

[87] PCT Pub. No.: WO90/10104

PCT Pub. Date: Sep. 7, 1990

[51] Int. Cl.[5] ..... D03D 47/34

[52] U.S. Cl. ..... 139/450; 139/452; 242/131

[58] Field of Search ..... 242/130, 131; 139/450, 139/452

[56] References Cited

U.S. PATENT DOCUMENTS 3,258,222 6/1966 Silva et al. ..... 242/130
3,640,440 2/1972 Sedlarik et al. ..... 139/452 X
3,693,904 9/1972 Bucher ..... 139/450
4,836,468 6/1989 Singer ..... 242/131
4,887,649 12/1989 Van Mullekom ..... 139/450

*Primary Examiner*—Andrew M. Falik
*Attorney, Agent, or Firm*—Kenyon & Kenyon

[57] ABSTRACT

In a loom having at least two weft accumulators (10, 11) disposed lengthwise adjacent the loom, and a bobbin holder (2) to receive weft bobbins (220, 221), one of the weft bobbins (220, 221) mounted on a table (21) is moved into the operative position to deliver weft yarn (31) to a weft accumulator (10). The bobbin holder is disposed compactly in a space which is bounded by the weft accumulators (10, 11) and transversely thereto by the loom (1) and which is longitudinally adjacent the same and laterally adjacent the accumulators (10, 11). At least two tables (21) with the weft bobbins (220, 221) are received one above another in the bobbin holder (2) and the weft yarn (31) are guided substantially transversely to the loom longitudinal axis from the bobbin holder (2) to the weft accumulators. This arrangement increases the number of weft bobbins which can be stored adjacent the loom (1) without any appreciable increase in the amount of space required as compared with a bobbin holder with only one table.

12 Claims, 3 Drawing Sheets

LOOM HAVING A COMPACT BOBBIN HOLDER

This invention relates to a loom having a compact bobbin holder.

As is known, looms have been provided with weft accumulators which are disposed laterally on the side of the loom frame for the feeding of weft yarns into the loom, for example, from a bobbin supply. For example, Swiss Patent 657,388 describes a relatively simple arrangement of supplying a weft yarn from a bobbin to a weft yarn accumulator for feeding into a shed of a weaving machine. In other cases, such as described in European Patent Application 0155431 and European Patent Application 0298025, at least two weft accumulators have been positioned laterally of a loom while one or more bobbins of weft yarn have been provided for feeding weft yarns to the accumulators for subsequent delivery to the loom. In particular, European Patent Application 0298025 describes the positioning of a weft bobbin changer and then a weft accumulator before the loom as considered in the direction of the longitudinal axis of the loom. The bobbin changer or holder has two turntables which are disposed one beside another and which receive weft yarn bobbins, one such bobbin at a time being adapted to be moved into the operative position to deliver weft yarn to a weft accumulator. After the weft yarn on a bobbin has been substantially exhausted the table rotates through a predetermined angle to move a fresh bobbin into the position of the previous bobbin. EP-A-0 298 025 also discloses means for joining the weft yarn of the new bobbin to the weft yarn of the previous bobbin.

The complete arrangement is relatively bulky since all the weft bobbins are disposed one beside another and take up space in the weaving shed outside the weft accumulators in the direction of the loom longitudinal axis.

It is the object of this invention to devise a very compact bobbin holder arrangement.

It is another object of the invention to reduce the space required for feeding a plurality of weft yarns to a loom.

It is another object of the invention to prevent tension peaks from occurring when a weft yarn is being drawn off a fresh bobbin during delivery to a loom.

Briefly, the invention provides a loom with at least two weft accumulators positioned longitudinally adjacent a side of the loom for feeding weft yarn to the loom longitudinally of the loom axis and a bobbin holder positioned longitudinally adjacent the same loom side and transversely adjacent the accumulators. The bobbin is provided with at least two tables, arranged one above the other, for receiving a plurality of bobbins of weft yarn and each is positioned for feeding weft yarns from the bobbins transversely of the loom axis to a selected weft accumulator.

The bobbin holder is thus disposed in a space which is bounded on one side by the weft accumulators and on a second transverse side by the loom.

This feature enables the space available laterally of and adjacent the weft accumulators transversely to the loom axis to be used without much space being required lengthwise of the complete arrangement over and above the space required by the weft accumulators. Despite the compactness of the bobbin holder, up to eight weft bobbins can be received in this way. Thus, the loom can be operated for longer time periods without the exhausted bobbins having to be replaced by fresh bobbins.

The weft bobbins can be mounted in a circle on a round table pivotable stepwise around a central axis by a drive. A yarn guide can be associated with each weft bobbin and is moved together with the table to guide the weft yarn above and beside the end of a weft bobbin, to ensure that weft yarn of any bobbin cannot catch in the weft yarn of some other bobbin. An intermediate accumulator for weft yarn can be disposed between two weft bobbins and can be embodied, for example, by an elongate U-section chamber, the chamber aperture being covered laterally on one long side of the intermediate store by a brush. The intermediate accumulator can be filled by an injector nozzle. The arrangement of the intermediate accumulator prevents tension peaks from occuring when the weft yarn is being drawn off a fresh bobbin when the same has still not reached its final position during the pivoting of the table.

These and other objects and advantages of the invention will become more apparent from the following detailed description taken in conjunction with the accompanying drawings wherein.

Figure 1:
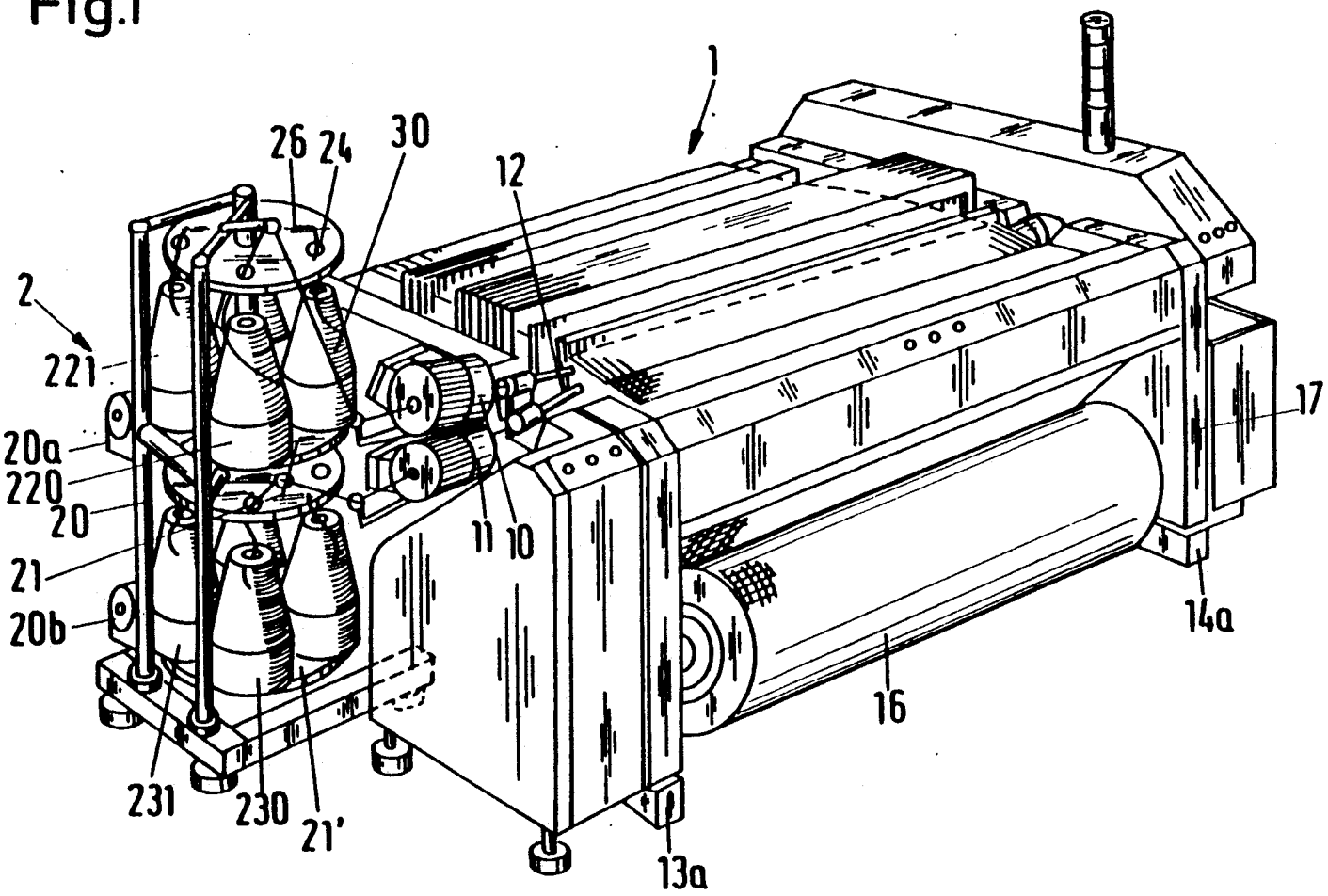
FIG. 1 is a perspective view of the loom with the bobbin holder according to the invention.

FIG. 1 shows a loom having air jet picking by means of nozzles 12 disposed on the left-hand side of loom frame 17. Disposed before each nozzle 12 is a weft accumulator 10, 11 which receives weft yarn from a bobbin holder 2. It is assumed that weft yarn from the bobbin 220 and bobbin 230 is woven alternately until the respective bobbins have become depleted to such an extent that they need replacing. In this event, the tables 21, 21' rotate further anticlockwise until the next bobbin, for example, the top bobbin 221, has moved into the position of the exhausted bobbin 220.

Figure 2:
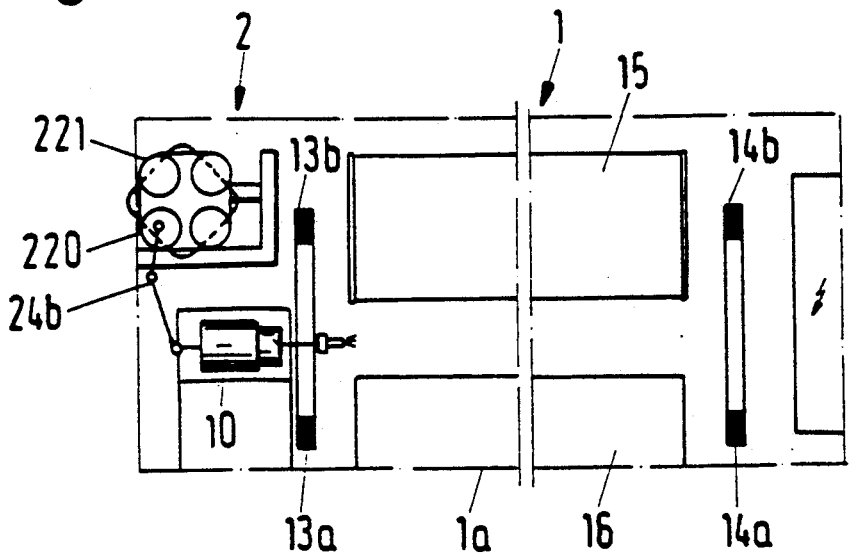
FIG. 2 shows a layout plan of the loom.

FIG. 2 shows the arrangement of the bobbin holder 2 relative to the loom 1 and accumulator 10. The loom 1 is carried on legs 13*a*, 13*b*, 14*a*, 14*b*. Disposed therebetween are inter alia a warp beam 15 and a cloth beam 16 which takes up the woven cloth. The bobbin holder 2 is disposed in a corner adjacent the loom 1 and adjacent a weft accumulator 10 and together therewith has space basically within the loom contour 1*a*.

Figure 3:
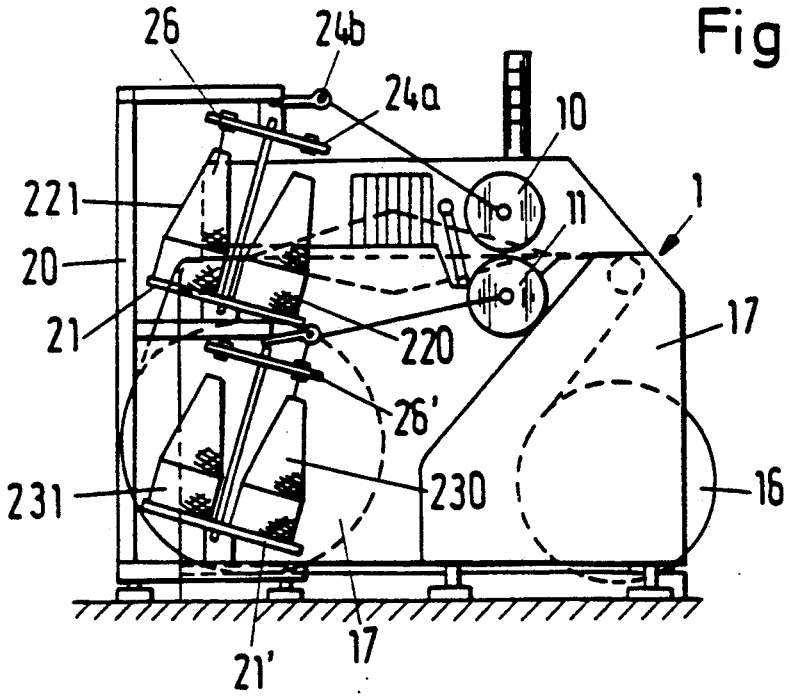
FIG. 3 shows a variant of the bobbin holder with the loom, the same being shown in side elevation.
Figure 4:
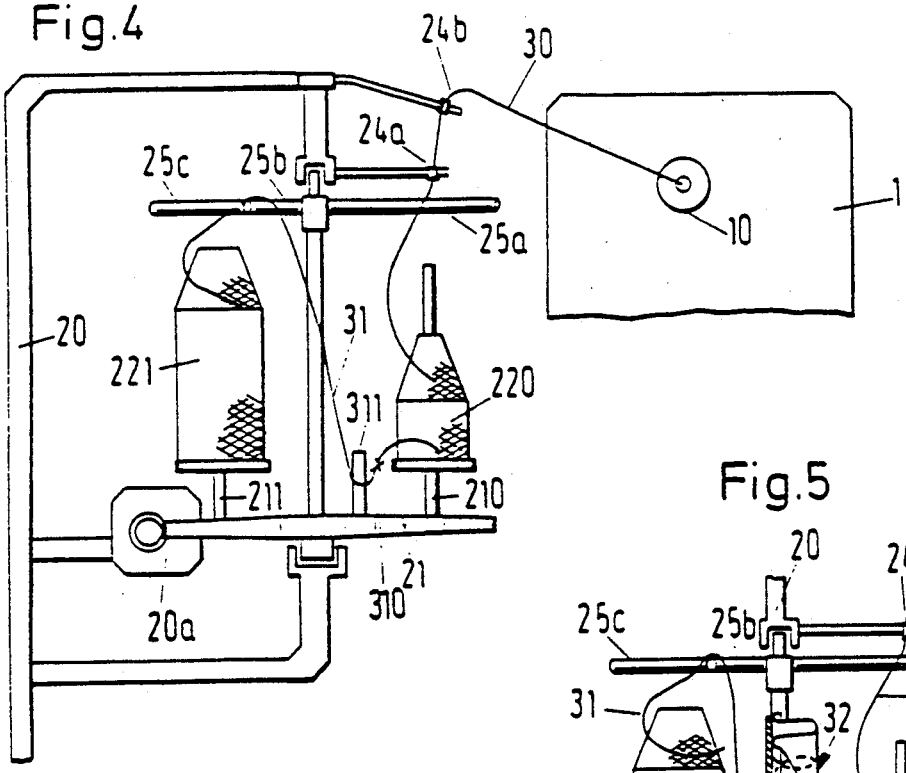
FIG. 4 is a partial view of the bobbin holder.

FIG. 3 shows a bobbin holder having inclined tables 21, 21'. The object of inclining the tables is to prevent smooth weft yarn from slipping off downwardly from the weft bobbins 220, 221. The angle of inclination can vary between 10° and 45° depending on the surface texture of the weft yarn. The tables 21, 21 are rotatably mounted inside the frame 20. Cover discs 26, 26' are disposed above the weft bobbins 220, 221 and 230, 231 and can be further rotated together with the tables 21, 21' and associated weft bobbins. Disposed in the discs 26, 26' are yarn guides 24, 24*a* for guiding the weft yarn upwards from the associated bobbin to another yarn guide 24*b* which deflects the yarn towards the accumulator 10. A similar yarn guiding facility is disposed in the bottom part of the bobbin holder for guiding the yarn from the bobbin 230 to the accumulator 11.

To change over from an exhausted weft bobbin 220 to a fresh weft bobbin, the method described in European patent application EP-O-298 025 for cutting and joining the weft yarn ends of the corresponding weft bobbins can be used; alternatively, the end of the weft yarn 30 wound on the bobbin 220 is joined previously in a join 310 to the start of the weft yarn 31 on the bobbin 221. So that the turns of yarn on the bobbins 220, 221 may be unwound satisfactorily, yarn guides 25*a*, 25*b* etc are disposed adjacent and above each weft bobbin 220, 221. When the weft yarn between discrete weft bobbins 220, 221 has been joined previously, the changeover from one weft bobbin to the other can take place without the loom 1 stopping. The end of the yarn supply on the bobbin 220 can be indicated, for example, by a sensor 311 which responds when weft yarn 31 containing the join 310 is drawn upwards. The loom control can activate a drive 20*a* on the table 21 which rotates the fresh weft bobbin 221 to the position of the previous bobbin 220 below the yarn guide 24*a*.

An intermediate accumulator 32 can be disposed between the bobbins 220 and 221 and weft yarn 31 can be drawn off the intermediate accumulator 32 as the table 21 continues to rotate after exhaustion of the bobbin 220 before the bobbin 221 has been moved by the rotating table 21 into a position in which the weft yarn can be drawn off satisfactorily through the guide 24*a*.

Figure 5:
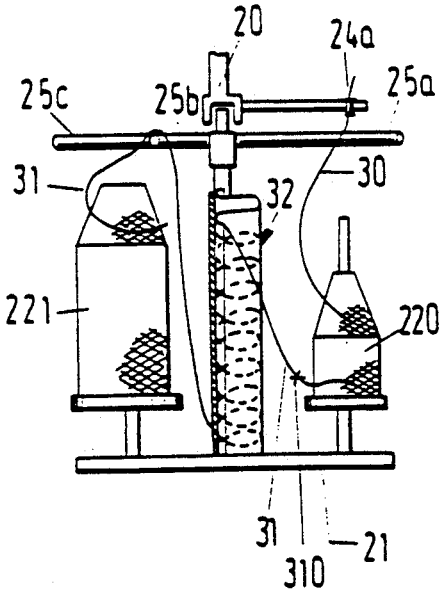
FIG. 5 shows a bobbin holder having an intermediate accumulator between two bobbins.
Figure 6:
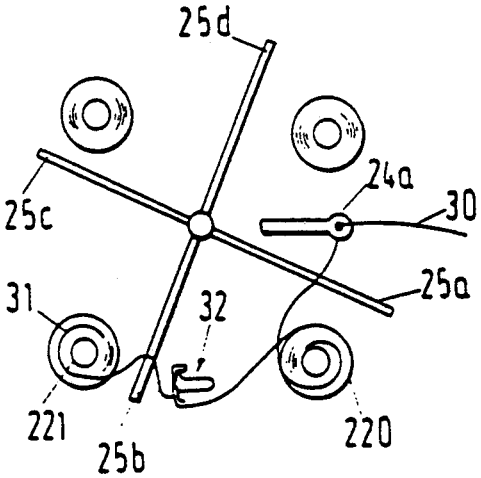
FIG. 6 is a plan view of the bobbin holder of FIG. 5.
Figure 7:
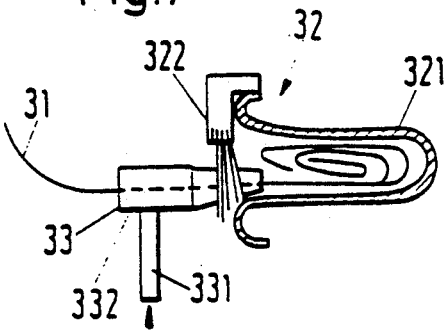
FIG. 7 is a partial view of the intermediate accumulator.

FIG. 6 is a plan view of the arrangement of FIG. 5. The yarn guides 25*a*, 25*b*, 25*c* and 25*d* can be horizontal rods which extend adjacent the weft bobbins 220, 221 etc. The intermediate accumulator takes the form in the embodiments of a U-shaped metal member arranged vertically defining a chamber for receiving loops of a weft yarn while a brush is disposed across an opening to the chamber in the member. The weft yarn 31 can be deposited in the inside of the U in the form of loops, as shown in FIG. 7, by being injected into the intermediate accumulator 32 by means of an injector nozzle 33 which moves vertically along the accumulator 32. The nozzle 33 has an air connection 331 and engages between the bristles of the brush 322. The brush 322 at the opening of the intermediate accumulator 32 is intended to retain the yarn loops in the chamber 321 and to ensure that they are drawn out of the same upwardly and downwardly in some sort of order when the supply of yarn on the bobbin 220 is exhausted. Conveniently, the interior of the chamber 321 has a non-slip covering to prevent the weft yarn from slipping in the intermediate accumulator 32. The nozzle 33 is formed with a peripheral slot 332 so that after the accumulator 32 has been filled, the weft yarn 31 can be removed laterally from the nozzle 33. The function of the intermediate accumulator 32 is to obviate tension peaks during the transition from the bobbin 220 to the bobbin 221 for as long as the bobbin 221 remains in an unsatisfactory position relatively to the yarn guide 24*a* as the table 21 continues to rotate.

What is claimed is:

1. A loom having at least two weft accumulators disposed lengthwise therebefore, and a bobbin holder which is adapted to receive weft bobbins and to move the weft bobbins, which are mounted on a table, into an operative position one at a time for the delivery of weft yarn to a weft accumulator, characterized in that an intermediate accumulator for weft yarn is disposed between two weft bobbins and the bobbin holder is disposed in a space which is bounded by the weft accumulators and by a loom side wherein said bobbin holder is positioned longitudinally adjacent said loom side and transversely adjacent said accumulators, and at least two tables with weft bobbins are received one above another in the bobbin holder, the weft yarns being guided substantially transversely to the loom longitudinal axis from the bobbin holder to the weft accumulators.

2. A loom according to claim 1, wherein the weft bobbins (220, 221) are mounted in a circle on a circular table (21) connected to a drive (20*a*).

3. A loom according to claim 1, wherein a yarn guide is disposed above and beside the top end of a weft bobbin.

4. A loom according to claim 1, wherein the intermediate accumulator is an elongate U-section chamber with an aperture on one long side which is covered by a brush.

5. A loom according to claim 4, wherein an injector nozzle formed with a lateral slot (332) is associated with the intermediate accumulator for filling the same with weft yarn (31).

6. In combination a loom having a longitudinal axis;

at least two weft accumulators positioned longitudinally adjacent a side of said loom for feeding weft yarn to said loom longitudinally of said axis; and a bobbin holder positioned longitudinally adjacent said loom side and transversely adjacent said accumulators, said holder having at least two tables for receiving a plurality of vertically disposed bobbins of weft yarn respectively thereon and being positioned for feeding weft yarn from the bobbins transversely of said axis to a selected weft accumulator.

7. The combination as set forth in claim 6 wherein each table is circular and is rotatably mounted within said holder.

8. The combination as set forth in claim 6 which further comprises a yarn guide above each table between each respective pair of adjacent bobbins thereon for guiding a joined length of weft yarn between said pair of bobbins.

9. The combination as set forth in claim 6 which further comprises a weft accumulator between a pair of bobbins on a respective table for accumulating a joined length of weft yarns between said pair of bobbins.

10. The combination as set forth in claim 9 wherein said accumulator includes a U-shaped member defining a chamber for receiving loops of a weft yarn and a brush disposed across an opening to said chamber in said member.

11. The combination as set forth in claim 10 which further comprises an injector nozzle for blowing air into said chamber, said nozzle having a laterally disposed slot for passage of a weft yarn into and out of said nozzle.

12. In combination a loom having a longitudinal axis;

at least two weft accumulators positioned longitudinally adjacent a side of said loom for feeding weft yarn to said loom longitudinally of said axis;

a bobbin holder positioned longitudinally adjacent said loom side and transversely adjacent said accumulators, said holder having at least two tables for receiving a plurality of bobbins of weft yarn respectively thereon and being positioned for feeding weft yarn from the bobbins transversely of said axis to a selected weft accumulator; and a weft accumulator between a pair of bobbins on a respective table for accumulating a joined length of weft yarns between said pair of bobbins.

* * * * *